US008955933B2

(12) United States Patent
Sato et al.

(10) Patent No.: US 8,955,933 B2
(45) Date of Patent: Feb. 17, 2015

(54) PRINTING APPARATUS AND PRINTING METHOD

(71) Applicant: Seiko Epson Corporation, Tokyo (JP)

(72) Inventors: Akito Sato, Nagano-ken (JP); Satoshi Yamazaki, Nagano-ken (JP); Keiko Yamada, Nagano-ken (JP); Yuko Yamamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/077,958

(22) Filed: Nov. 12, 2013

(65) Prior Publication Data

US 2014/0139577 A1 May 22, 2014

(30) Foreign Application Priority Data

Nov. 20, 2012 (JP) ..... 2012-254178

(51) Int. Cl.
*B41J 29/38* (2006.01)
*B41J 2/165* (2006.01)
*B41J 2/17* (2006.01)

(52) U.S. Cl.
CPC ..... *B41J 2/16526* (2013.01); *B41J 2/16585* (2013.01); *B41J 2/1714* (2013.01)
USPC ..... 347/12; 347/6

(58) Field of Classification Search
CPC ..... B41J 29/393; B41J 2/155; B41J 2/04553; B41J 2/04571; B41J 2202/21; B41J 2/04568
USPC ..... 347/6, 12, 17, 40, 42, 14
See application file for complete search history.

(56) References Cited

U.S. PATENT DOCUMENTS 8,534,793 B2 * 9/2013 Shinoda ..... 347/29
2012/0194606 A1 8/2012 Shinoda

FOREIGN PATENT DOCUMENTS

JP 06-015815 A 1/1994
JP 2007-136722 A 6/2007
JP 2012-158070 A 8/2012

* cited by examiner

*Primary Examiner* — An Do

(57) ABSTRACT

A printing apparatus which can form an image formation dot for printing an image defined as an object to be printed on a printing medium, the printing apparatus comprising a line head which includes a nozzle array arraying a plurality of nozzles, by moving at least one of a printing medium and the head, in a direction intersecting a direction relatively changing a position of the printing medium and the head and a control unit which performs a specific operation forming a flushing dot besides the image formation dot by discharging a liquid on the line head, wherein, when a specific condition increasing viscosity of the liquid is satisfied, the control unit performs the specific operation of discharging the liquid to the printing medium and the specific operation of discharging the liquid to a place other than the printing medium.

11 Claims, 4 Drawing Sheets

PRINTING APPARATUS AND PRINTING METHOD

BACKGROUND

1. Technical Field

The present invention relates to a printing apparatus.

2. Related Art

An ink jet printer which performs printing by discharging ink from a plurality of nozzles has been known. In the ink jet printer, when a state where the ink is not discharged from the nozzle is maintained, moisture of the ink from the nozzle openings evaporates to increase the viscosity of the ink. When the viscosity of the ink is increased, the nozzles can be clogged to cause a discharge operation of the ink to become difficult. In order to prevent such problem from occurring, by performing so-called flushing, by the process of discharging the ink from each nozzle by force, it is preferable to prevent or remove clogging of the nozzle.

In the related art, an ink jet printer has been known which moves the nozzle to a position corresponding to a printing sheet and performs a recovery process by flushing to print a character and a picture in a rectangular shape (refer to JP-A-06-15815). In addition, a droplet discharging apparatus has been known, which prevents dot spread and an increase in density to make the dummy jet pattern difficult to be recognized by randomly disposing a dot in a dummy jet pattern formed on a sheet at intervals of one dot or more in an X or Y direction so that each dot may not be adjacent to each other or may not overlap each other (refer to JP-A-2007-136722).

In JP-A-06-15815, a printing speed is improved by performing flushing on a printing sheet more than by performing flushing on a waste ink absorber. However, since the character and the picture in a rectangular shape are printed by flushing on the printing sheet, there is a concern that a user may make a low evaluation for the printing result. In addition, even in the JP-A-2007-136722, since a dummy jet pattern is printed on a sheet by flushing when an image quality priority mode is not selected, degradation of an image quality is inevitable. On the other hand, in printing processing, whether a priority is given to a speed or an image quality depends on a user. In other words, there is a problem in accurately realizing the printing process according to the demand of a user for the printing speed or the image quality. Moreover, it has been required to realize the printing speed and the image quality at an optimal balance considering various conditions, which a user randomly selects with respect to printing, other environmental conditions, and the like.

SUMMARY

An advantage of some aspects of the invention is to provide a printing apparatus which can perform appropriate processing according to the demand of a user and obtain a printing result with high satisfaction of the user.

According to an aspect of the present invention, there is provided a printing apparatus which can form an image formation dot for printing an image defined as an object to be printed by discharging a liquid, and which includes a line head which is a head having a plurality of nozzles and has a nozzle array arraying the plurality of nozzles, by moving at least one of a printing medium and the head, in a direction intersecting a direction relatively changing a position of the printing medium and the head; a selection receiving unit which receives a selection of one of a first printing mode and a second printing mode giving priority to a printing speed rather than the first printing mode; and a control unit which performs a specific operation of forming a flushing dot besides the image formation dot by discharging a liquid on the line head, and in which the control unit, when a selection of the second printing mode is received, performs the specific operation of discharging the liquid to the printing medium on the line head to cause a selection of the second printing mode to be received, and when a specific condition to increase viscosity of the liquid in a nozzle compared to a predetermined condition is satisfied, performs the specific operation of discharging the liquid to the printing medium and the specific operation of discharging the liquid to a place other than the printing medium on the line head.

In this configuration, when a user selects the second printing mode, the printing apparatus performs a specific operation (flushing) of discharging the liquid to a printing medium. That is, when a user gives priority to a printing speed rather than an image quality, flushing is performed to the printing medium, and thereby time required for the entire printing is shortened. In particular, a model equipped with the line head requires more time when performing flushing on a place other than the printing medium than a model where a printing head can move in a main scanning direction. Therefore, a configuration of the invention greatly contributes to a fast speed of printing in the printing apparatus equipped with the line head. In addition, in this configuration, when a user selects the second printing mode and the specific condition is satisfied, flushing is performed on a place other than a printing medium to prevent excessive degradation of an image quality by performing flushing only on the printing medium. Therefore, it is possible to realize the image quality and the printing speed that a user demands at an optimal balance.

In addition, according to the aspect of the invention, the selection receiving unit may receive a selection of printing setting among a plurality of printing settings which include the first printing setting where the speed of the movement is a first speed and the second printing setting where the speed of the movement is a second speed which is slower than the first speed, and the control unit may satisfy the specific condition when the selection receiving unit receives a selection of the second printing setting.

In this configuration, when a user selects the second printing mode and the second printing setting, in order to prevent an excessive degradation of an image quality by performing only flushing on the printing medium, flushing is performed on a place other than the printing medium. Therefore, it is possible to realize an image quality and a printing speed that a user demands at an optimal balance.

In addition, according to the aspect of the invention, the printing apparatus may further include a viscosity detection unit detecting the viscosity of the liquid in the nozzle, and when the selection receiving unit receives a selection of the second printing mode and a selection of the second printing setting, the control unit may be configured to set the number of discharges of the liquid to the printing medium by the specific operation per a fixed movement distance to be constant regardless of the speed of the movement, and to perform the specific operation of discharging the liquid to a place other than the printing medium when a viscosity detected by the viscosity detection unit reaches a predetermined threshold value of the viscosity.

In this configuration, the number of discharges of the liquid by flushing to the printing medium per the fixed movement distance is constant regardless of the speed of the movement. Therefore, it is possible to prevent an excessive degradation of an image quality by flushing to the printing medium. In addition, at a timing when an amount of flushing may not be sufficient in flushing to the printing medium, flushing is performed to a place other than the printing medium, so that it is possible to extremely inhibit time required for the entire printing from being increased.

For example, the first printing setting is a setting in which printing is performed by the first printing resolution, and the second printing setting is a setting in which printing is performed by the second printing resolution higher than the first printing resolution. In addition, for example, the first printing setting is a setting in which printing is performed on one side of the printing medium, and the second printing setting is a setting in which printing is performed on both sides of the printing medium.

In addition, according to the aspect of the invention, the printing apparatus may further include a temperature/humidity detection unit which detects temperature and/or humidity of environment, and the control unit may satisfy the specific condition when the temperature/humidity detection unit detects temperature equal to or more than a predetermined threshold value of temperature and/or humidity equal to or less than a predetermined threshold value of humidity.

In this configuration, when a user selects the second printing mode, and temperature equal to or more than the predetermined threshold value of temperature and/or humidity equal to or less than the predetermined threshold value of humidity is detected, in order to prevent an excessive degradation of an image quality by performing flushing only on the printing medium, flushing is performed on a place other than the printing medium. Therefore, it is possible to realize the image quality and the printing speed at an optimal balance considering the environmental condition.

In addition, according to the aspect of the invention, the printing apparatus may further include a viscosity detection unit which detects the viscosity of the liquid in the nozzle, and when the selection receiving unit receives a selection of the second printing mode, and the temperature/humidity detection unit detects temperature equal to or more than the predetermined threshold value of temperature and/or humidity equal to or more than the predetermined threshold value of humidity, the control unit sets the number of discharges of the liquid to the printing medium by the specific operation per a fixed movement distance to be constant regardless of a result of detection by the temperature/humidity detection unit, and the viscosity detected by the viscosity detection unit reaches a predetermined threshold value of the viscosity, the specific operation of discharging the liquid to a place other than the printing medium may be performed.

In this configuration, the number of discharges of the liquid by the flushing to the printing medium per a fixed movement is constant regardless of a result of detection by the temperature/humidity detection unit. Therefore, it is possible to prevent an excessive degradation of an image quality by flushing to the printing medium. In addition, at a timing when an amount of flushing may not be sufficient with flushing only to the printing medium, flushing is performed to a place other than the printing medium, so that it is possible to extremely inhibit an increase of time required for the entire printing.

In addition, according to the aspect of the invention, the printing apparatus may further include a humidification liquid tank which stores a humidification liquid having a non-volatile component, and a humidified air supply unit which supplies air humidified by a humidification liquid stored in the humidification liquid tank to a sealed space opposite to the opening of the nozzle. The control unit, when a humidification function by the humidified air supply unit is degraded more than a predetermined reference, may satisfy the specific condition.

In this configuration, when a user selects the second printing mode, and a humidification function by the humidified air supply unit is degraded more than the predetermined reference, in order to prevent an excessive degradation of the image quality by performing flushing only to the printing medium, flushing is performed to a place other than the printing medium. Therefore, it is possible to realize the image quality and the printing speed at an optimal balance by adding the humidification function by the humidified air supply unit.

The control unit may determine whether an amount of the non-volatile components in the humidification liquid stored in the humidification liquid tank is equal to or more than a regulated amount, and when the amount of the non-volatile components is equal to or more than the regulated amount, the humidification function by the humidified air supply unit is degraded more than a predetermined reference.

A technical concept according to the invention may be embodied not only in the printing apparatus, but also in other devices (apparatuses). In addition, it is possible to understand the invention of a method (printing method) which includes corresponding to a property of the printing apparatus according to any aspect described above, the invention of a printing control program causing predetermined hardware (computer) to perform the method, and the invention of a computer-readable recording medium recording the program. In addition, the printing apparatus may be realized by a single apparatus (a printer having a liquid discharge function), and realized by a combination of several devices.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described referring to drawings.

1. Outline of the Apparatus

Figure 1:
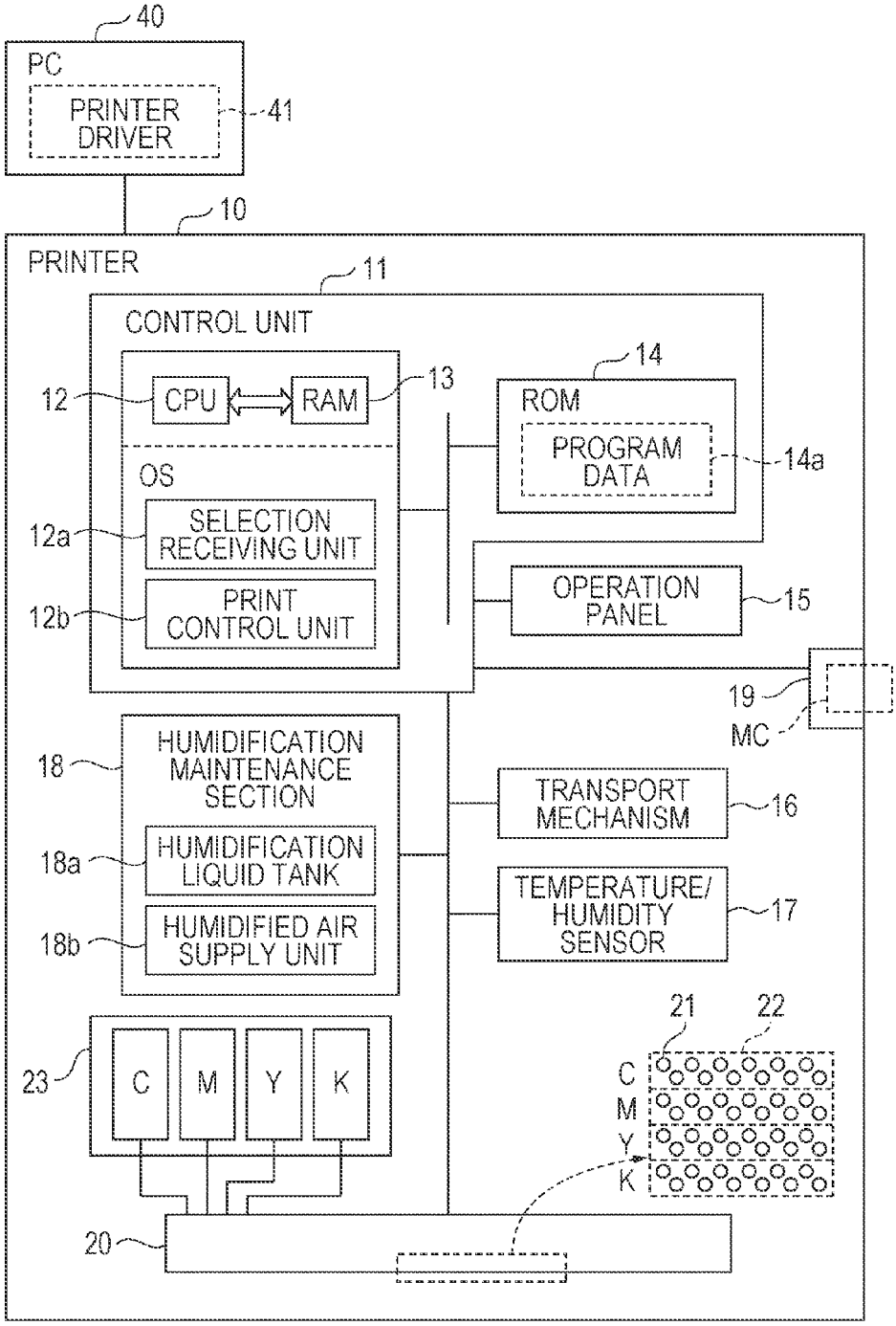
FIG. 1 is a diagram schematically showing a hardware configuration and a software configuration.

FIG. 1 schematically shows a hardware configuration and a software configuration according to the embodiment. FIG. 1 shows a personal computer (PC) 40 and the printer 10. The printer 10 corresponds to a printing apparatus. Alternately, a system including the PC 40 and the printer 10 may be regarded as the printing apparatus. The printer 10 includes a control unit 11 for controlling liquid discharge processing (printing process). In the control unit 11, the CPU 12 deploys program data 14*a* stored in a memory such as a ROM 14 and the like to a RAM 13 and performs calculation according to program data 14*a* under OS, and thereby firmware for controlling the apparatus itself is performed. The firmware is a program for performing each function of the selection receiving unit 12*a*, the print control unit 12*b*, and the like on the CPU 12. Each function of these will be described below.

A print control unit 12*b*, for example, inputs image data from a storage media and the like which are inserted from outside into the PC 40 and the printer 10 to generate print data from the image data. Then, it is possible to realize printing based on the print data. The storage media inserted from outside into the printer 10 is, for example, a memory card MC, and the memory card MC is inserted to a slot portion 19 formed in the casing of the printer 10. In addition, the print control unit 12*b* can input image data from various external devices such as a scanner connected to the printer 10 by wired or wireless, a digital still camera, a portable terminal, and even a server connected through a network. The image data shows an image (an image to be printed) randomly specified as an object to be printed by a user. The image data are, for example, bit map data, and are either RGB data having a gradation of a color system of red, green, blue (R, G, B) for each pixel or ink amount data having a gradation of an ink color system (cyan (C), magenta (M), yellow (Y), black (K), and the like) used by the printer 10 for each pixel. The print control unit 12*b* performs resolution conversion processing, conversion processing of the color system (color conversion processing), halftone processing, and the like on the bit map data to generate the print data. The print data are, for example, raster data defining discharge (dot on) or non-discharge (dot off) of a liquid (ink) for each pixel.

Alternatively, the print control unit 12*b* receives print data, generated from the image data, from a PC 40 using the printer driver 41 where the PC 40 is mounted, and thereby printing based on the received print data can be realized. Alternatively, the print control unit 12*b* receives PDL data shown in a predetermined page description language (PDL) from the printer driver 41, and thereby realizes printing of an image to be printed based on the PDL data. In this case, the print control unit 12*b* converts the PDL data into an intermediate code by interpreting the PDL data and further deploys the intermediate code, and thereby generates the above-described bit map data on a RAM 13. The print control unit 12*b* generates print data as described above from the bit map data.

An ink cartridge 23 of each of a plurality of types of ink is mounted on the printer 10. In an example of FIG. 1, the ink cartridge 23 corresponding to each ink of CMYK is mounted. However, the detailed type and the number of inks used by the printer 10 are not limited thereto, but various inks, for example, light cyan, light magenta, orange, green, gray, light gray, white, metallic ink, and the like can be used. In addition, the printer 10 includes the print head 20 which discharges (ejects) ink supplied from each ink cartridge 23 from a nozzle 21 for discharging a plurality of types of ink.

The print head 20 in the embodiment is a so-called line head which is a long shape. For example, the print head 20 is fixed to a predetermined position in the printer 10. The print head 20 has a longitudinal direction which is a direction intersecting a movement direction (transportation direction) of the printing medium, and includes a nozzle array arraying a plurality of nozzles 21 in the longitudinal direction. Here, 'intersect' means 'orthogonal'. However, 'orthogonal' in this specification does not mean only an exact angle (90°), but this means to include the angular error within an acceptable extent of quality of product. The nozzle array has a length corresponding to at least a width of a region which can be printed on the printing medium across the width of the printing medium in the longitudinal direction. In addition, the nozzle array is provided for each ink type used by the printer 10.

FIG. 1 illustrates some of each nozzle array for each of CMYK in a nozzle opening surface 22 of the print head 20 (a surface on which an opening of a nozzle is formed) in a range surrounded by a chain line. Each nozzle array of each of the CMYK is disposed along the transportation direction. The nozzle density (the number of nozzles/inch) of the longitudinal direction in each nozzle array is equal to the printing resolution (dpi) in the longitudinal direction. In addition, each nozzle array may be configured to only have a row of nozzle array aligned along the longitudinal direction, and, as illustrated in FIG. 1, may be configured to have a plurality of nozzle arrays deviated at a predetermined pitch in the longitudinal direction.

The print control unit 12*b* generates a drive signal for driving a print head 20 and a transportation mechanism 16 based on the print data. A piezoelectric element for discharging an ink droplet (dot) from a nozzle 21 onto each nozzle 21 is provided in the print head 20. The piezoelectric element is deformed when the drive signal is applied, and causes a dot to be discharged from a corresponding nozzle 21. The transportation mechanism 16 includes a motor (not shown) and rollers 16*a*, 16*b*, and 16*c* (refer to FIG. 2), and transports the printing medium along the transportation direction by being driven and controlled by the print control unit 12*b*. When the ink is discharged from each nozzle 21 of the print head 20, a dot is attached to the printing medium while being transported and thereby an image to be printed is reproduced on the printing medium based on the print data.

The printer 10 further includes an operation panel 15. The operation panel 15 includes a display unit (for example, Liquid Crystal Panel), a touch panel formed in the display unit, or various types of buttons or keys, and receives an input from a user or displays a necessary user interface (UI) screen using the display unit. In addition, the printer 10 may include the temperature/humidity sensor 17 and a humidification maintenance section 18.

Figure 2:
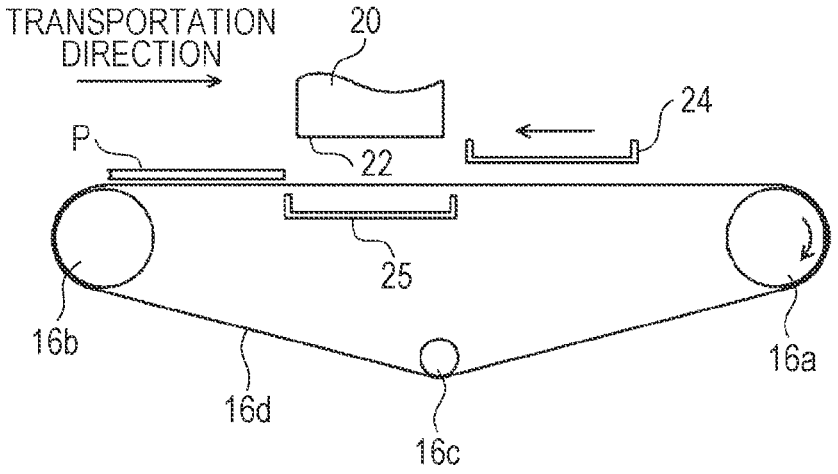
FIG. 2 is a diagram illustrating by an example of a configuration near a print head.

FIG. 2 illustrates by an example of a configuration of the vicinity of the print head 20 from a perspective facing the longitudinal direction of the print head 20. As shown in FIG. 2, at a position opposite to a nozzle opening surface 22 of the print head 20, an endless belt 16*d* is disposed which is locked to rotating rollers 16*a*, 16*b*, and 16*c* to move. The printing medium P is loaded on the endless belt 16*d*. Accordingly, the printing medium receives discharge of ink when being transported in the transportation direction and passing under the nozzle opening surface 22.

In the embodiment, primarily, the print head 20 is fixed, and the description is continued assuming a configuration in which the printing medium is transported by the transportation mechanism 16. However, with respect to the printing medium which does not move (or whose movement is temporarily suspended), the print head 20 can adapt a configuration in which the print head 20 moves by a carriage. That is, a configuration in which at least one of the printing medium and the print head 20 moves to relatively change a position of the printing medium and the print head 20 in a fixed direction may be adapted. Even when the print head 20 moves, the longitudinal direction is a direction intersecting with a direction (the fixed direction) relatively changing the position of the printing medium and the print head 20. In this sense, a "movement distance" in claims is an amount of changes in a position between the printing medium and the print head 20 in the fixed direction, and a "movement speed" in claims is the amount of changes per unit time.

In the embodiment, the printer 10 can perform flushing. The flushing is a specific operation forming a dot besides dots for printing the image to be printed by discharging ink from the nozzle 21. The dots for printing the image to be printed (dots configuring the print data) can be referred to as an image formation dot, and a dot besides the image formation dot may be referred to as a flushing dot. In addition, the flushing includes a "first flushing" that discharges ink to a place other than the printing medium, and a "second flushing" that discharges ink to the printing medium. FIG. 2, as an example of a configuration for realizing the first flushing, shows a waste liquid cap 24. The waste liquid cap 24 moves under the nozzle opening surface 22 at a timing when the first flushing is performed according to a control by the control unit 11 to cover the nozzle opening surface 22. The print head 20 causes ink to be discharged from each nozzle 21 as the first flushing with the nozzle opening surface 22 covered by the waste liquid cap 24. Accordingly, the discharged ink is stored in the waste liquid cap 24. The waste liquid cap 24 returns to an original predetermined position after completion of the first flushing according to a control by the control unit 11.

In addition, as an example of the first flushing, the printer 10 may perform flushing on the endless belt 16*d*. In this case, at a position opposite to the nozzle opening surface 22 across the endless belt 16*d*, a waste tray 25 for receiving waste liquid is disposed. For example, the endless belt 16*d* may be formed with a mesh surface and cause the ink discharged to a belt surface to pass through. The print head 20, as the first flushing, causes ink to be discharged from each nozzle 21 at a predetermined timing when the printing medium is not present under the nozzle opening surface 22. Accordingly, the discharged ink is stored in the waste tray 25 through the endless belt 16*d*. The printer 10 may include a wiper for cleaning the belt surface of the endless belt 16*d* contaminated when ink discharged by the first flushing passes through.

2. Flushing Control Processing

Figure 3:
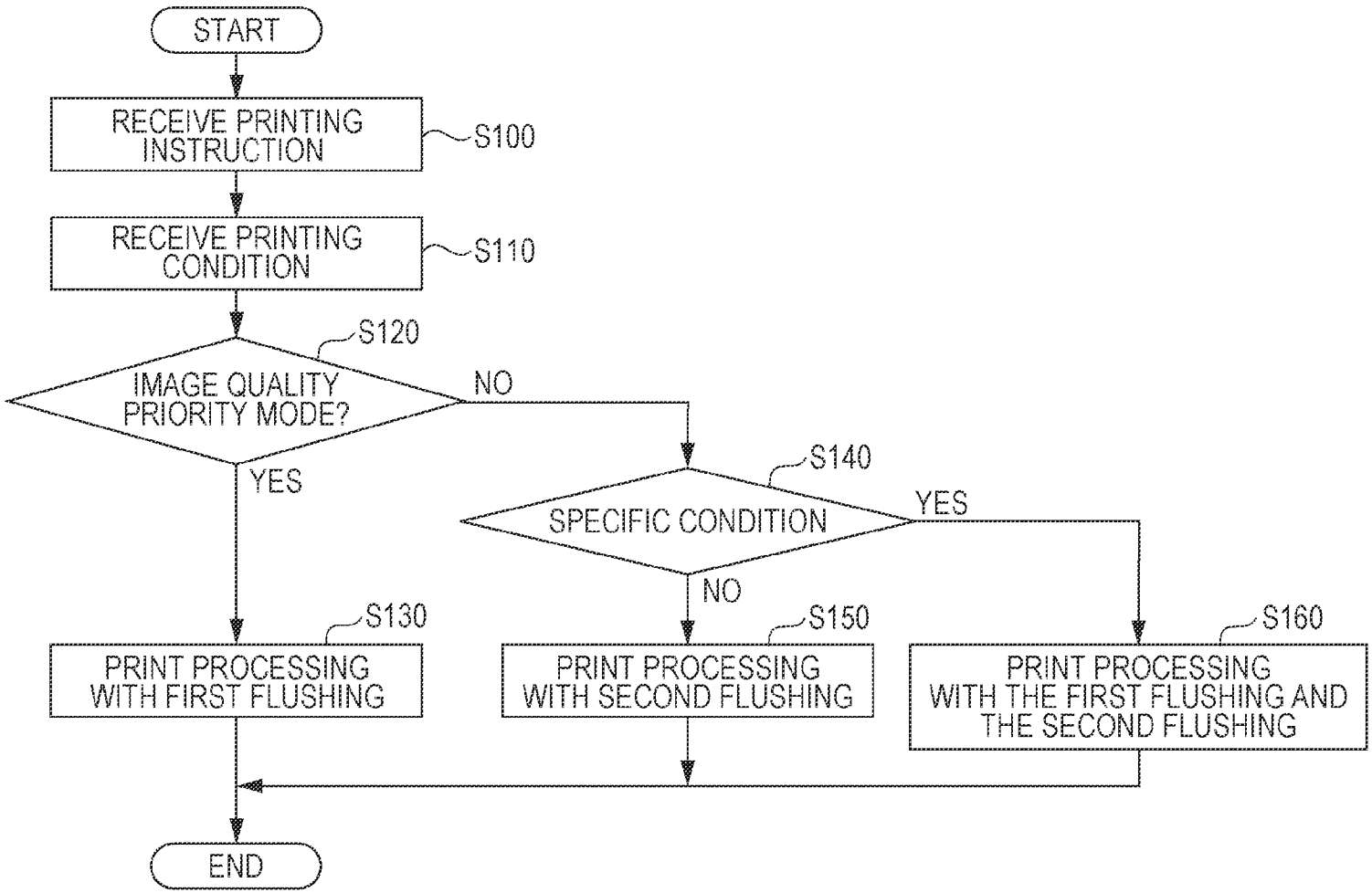
FIG. 3 is a flowchart showing flushing control processing.

FIG. 3 shows flushing control processing performed under the configuration described above using a flowchart. The flushing control processing means processing of dividing the first and the second flushing according to situation, and basically is performed in combination with the printing process of the image to be printed. The printing process of the image to be printed is described above, so that the appropriate description will be omitted.

In step S100, the print control unit 12*b* receives an instruction of printing of an image to be printed from a user through an operation panel 15. That is, the user operates the operation panel 15, thereby randomly selecting the image to be printed through a UI screen displayed on the display unit to instruct printing of the image to be printed to the printer 10. Accordingly, image data expressing the image to be printed are obtained from a PC 40, a storage medium, any information source of the external device, and the like as described above. Of course, the user may perform a printing instruction of the image to be printed by operating a portable terminal which can remotely operate the printer 10 from the outside.

In step S110, the selection receiving unit 12*a* receives a printing condition when printing the image to be printed according to a user input through the operation panel 15 (or, the portable terminal and the like which can remotely operate). More specifically, the selection receiving unit 12*a* receives various types of printing condition such as a type of the printing medium, an orientation of printing, allocation to the printing medium, printing resolution, a request of two-sided printing, and the like besides a selection between "image quality priority mode" and "speed priority mode". In the embodiment, the selection receiving unit 12*a* receives at least an alternative selection between the image quality priority mode and the speed priority mode. The image quality priority mode is a mode selected when a user gives priority to an improvement of an image quality of a printing result rather than an increase of the printing speed, and corresponds to a first printing mode in claims. On the other hand, the speed priority mode is a mode selected when a user gives priority to an improvement of the printing speed rather than an increase of the image quality, and corresponds to a second printing mode in claims.

The user can cause the printer 10 to print the image to be printed by operating the PC 40. That is, as described above, this is a case where the printer 10 receives print data and PDL data from the printer driver 41. In this case, the user inputs a print instruction and a printing condition of the image to be printed through a UI screen presented on a display of the PC 40 by the printer driver 41. In addition, information showing the input printing condition is transmitted to the printer 10 from the PC 40 side with the print data and the PDL data. Accordingly, the selection receiving unit 12*a*, when the transmitted information of printing condition is received with the print data and the PDL data from the PC 40 side, can be regarded to receive the printing condition.

In step S120, the print control unit 12*b* branches processing by whether selection of either of the image quality priority mode and the speed priority mode is received or not in step S110. In this case, when selection of the image quality priority mode is received ("Yes" in step S120), the process proceeds to step S130, and on the other hand, when selection of the speed priority mode is received ("No" in step S120), the process proceeds to step S140.

In step S130, the print control unit 12*b* performs a printing process of the image to be printed along the first flushing. The first flushing is basically performed at a timing between pages to print. For example, the print control unit 12*b* causes transportation of the printing medium by the transportation mechanism 16 to stop whenever printing of the image to be printed to the predetermined number of printing medium (some of the image to be printed) is finished. In addition, the waste cap 24 is caused to move under the nozzle opening surface 22 when necessary. The print control unit 12*b* gives a drive signal (a signal independent from the image to be printed. A type of data other than the print data) causing a flushing dot to be discharged the predetermined number of times from the entire print head 20 or some of the nozzles 21, to the print head 20. Accordingly, ink discharge is forced to be performed on a place other than the printing medium (the waste cap 24 and the endless belt 16*d*) to achieve prevention or solution of clogging of the nozzles 21.

When printing of an entire image to be printed is not finished after completion of the first flushing, printing is resumed. When the first flushing is performed on the waste cap 24, the flushing does not have to be performed at a timing between pages, but can be performed at a timing when the image to be printed is printed in one distribution to the middle of the printing medium. The first flushing does not cause the flushing dot independent from the image to be printed to be landed on the printing medium, thereby greatly contributing to the improvement of the print image quality.

In step S140, the print control unit 12*b* determines whether a specific condition for increasing the viscosity of ink in the nozzle 21 is satisfied compared to a predetermined condition. Then, when the specific condition is not satisfied ("No" in the step S140), the process proceeds to step S150, and when the specific condition is satisfied ("Yes" in step S140), the process proceeds to step S160.

In step S150, the print control unit 12*b* performs a printing process of the image to be printed along with "the second flushing". That is, when the speed priority mode is selected and the specific condition is not satisfied, the second flushing is performed as the flushing. A specific method of the second flushing is not particularly limited. For example, the print control unit 12*b* is a pixel row configuring the image to be printed, and generates data (flushing data. A type of data other than the print data), which expresses a dot pattern to cause a flushing dot repeatedly to be discharged at fixed distance intervals, in a pseudo manner at the entire pixel row which is parallel to the transportation direction. Then, the print control unit 12*b* overlaps (synthesizes) the print data indicating the image to be printed and the flushing data to perform ink discharge on the print head 20 based on the overlapped data. At this time, since a dot is formed on the printing medium to correspond to each pixel where dot-on is obtained by the logical AND of the overlap result, printing of the image to be printed and prevention or solution of the clogging of the nozzles 21 are achieved. A dot formed on the printing medium to correspond to a pixel where the dot-on is defined even in any of the data when overlapping the print data indicating the image to be printed and the flushing data are the image formation dot and the flushing dot. The second flushing does not perform printing of the image to be printed by being temporarily suspended like the first flushing, thereby greatly contributing to the improvement of the printing speed.

On the other hand, in step S160, the print control unit 12*b* performs printing processing of the image to be printed with "the first flushing" and "the second flushing". That is, when the speed priority mode is selected and the specific condition is satisfied, not only the second flushing but also the first flushing is performed, thereby maintaining the effect of inhibiting the clogging of the nozzle 21. When the speed priority mode is selected in any of the modes, the print control unit 12*b* causes at least the second flushing to be performed on the print head 20.

Here, in the embodiment, the "specific condition" is regarded as that "the selection receiving unit 12*a*" receives a selection of a second printing setting from a plurality of printing settings including a first printing setting in which the transportation speed of the printing medium (or movement speed of the print head 20. Any type of the movement speed) is a first speed and the second printing setting in which the transportation speed of the printing medium is a second speed which is slower than the first speed. The printer 10 may realize a plurality of printing resolutions in the transportation direction, and the user may select any printing resolution among the plurality of printing resolutions. Therefore, when the user selects a printing resolution (a second printing resolution) which is higher than a predetermined printing resolution (a first printing resolution) which is a reference among the plurality of printing resolutions, this is regarded as a printing setting of "high-resolution printing" being selected. When the high-resolution printing is selected, the transportation speed of the printing medium using the transportation mechanism 16 is set to a speed (a second speed) which is slower than a reference speed (a first speed), thereby realizing the high-resolution printing. Alternately, in a configuration where the print head 20 moves with respect to the printing medium which does not move (or whose movement is temporarily suspended), the movement speed of the print head 20 is set to a speed (the second speed) which is slower than the reference speed (the first speed), thereby realizing the high-resolution printing. Accordingly, for example, the first printing setting is a setting in which printing is performed by the first printing resolution, and the second printing setting is a setting of the high-resolution printing in which printing is performed by the second printing resolution.

In addition, the printer 10 may realize one-sided printing and two-sided printing with respect to the printing medium, and the user may randomly select one of the one-sided printing and the two-sided printing. When the two-sided printing is selected, in order to prevent ink on a printed surface from contaminating the endless belt 16*d* and the like when inverting bleed-through of the ink and the printing medium, it is necessary to ensure more drying time. Therefore, when the two-sided printing is selected, the transportation speed of the printing medium by the transportation mechanism 16 (or the movement speed of the print head 20) is a speed (the second speed) which is slower than a speed (the first speed) of one-sided printing. Accordingly, for example, the first printing setting is a setting in which the one-sided printing is performed, and the second printing setting is a setting in which the two-sided printing is performed.

The slower transportation speed of the printing medium (or the movement speed of the print head 20) means that more time is required to print the same length of printing region in the transportation direction (or the movement direction of the print head 20), and this brings increased viscosity of ink in the nozzle 21 compared to a predetermined condition which is a reference (in the case of the first printing resolution and the one-sided printing). Accordingly, when at least one of "the high-resolution printing" and "the two-sided printing" is selected as a printing condition, the step S140 performs a determination of "Yes".

Figure 4A:
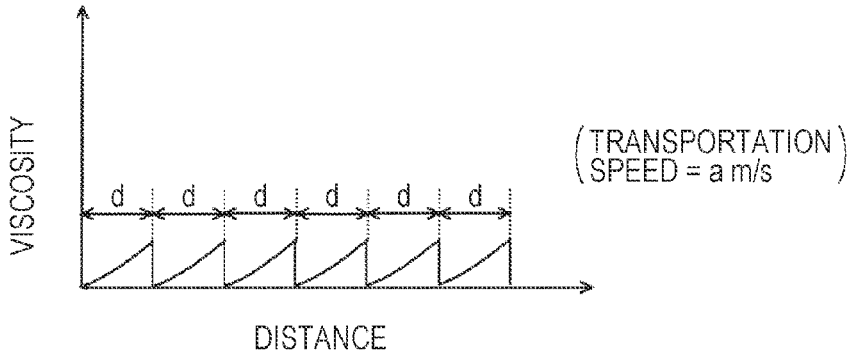
FIGS. 4A and 4B are diagrams each illustrating an example of flushing timing.
Figure 4B:
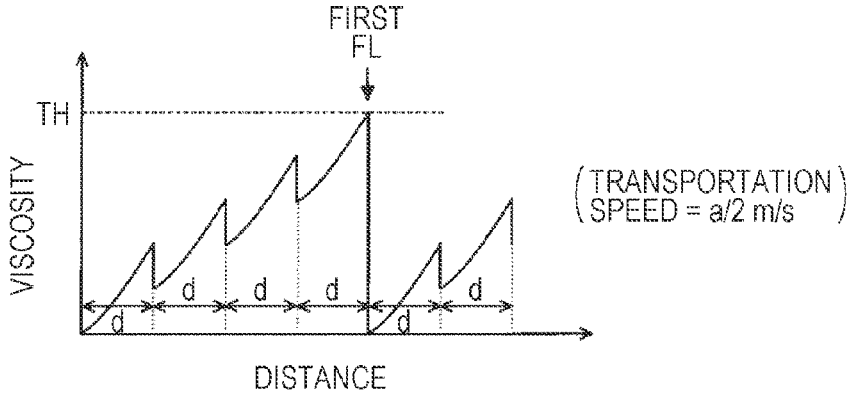

FIGS. 4A and 4B are diagrams each illustrating an example of flushing timing in step S150 and step S160. FIG. 4A illustrates a relation between the transportation distance d of the printing medium (a type of "the movement distance") and the viscosity of the ink in the nozzle 21 when the second flushing only is performed as the flushing (step S150). In FIG. 4A, each nozzle 21 of the print head 20 discharges one dot per the transportation distance d of the printing medium onto the printing medium by the second flushing. In addition, the transportation speed of the printing medium by the transportation mechanism 16 is a [m/s]. According to FIG. 4A, the viscosity of the ink in the nozzle 21 is lowered to a substantially fixed level whenever discharging one dot per the transportation distance d, and as a result, an increase in the viscosity of the ink is definitely inhibited. The "viscosity" shown in FIGS. 4A and 4B is a generic term of an indicator directly or indirectly showing the viscosity of the ink in the vicinity of an opening of the nozzle 21, and is, for example, a lack of moisture and solvent per unit volume of the ink or a ratio of a pigment to a dye per the unit volume.

FIG. 4B illustrates a relation between the transportation distance of the printing medium (a type of the "movement distance") and the viscosity of the ink in the nozzle 21 when the first flushing and the second flushing are performed as the flushing (step S160). In FIG. 4B as in FIG. 4A, each nozzle 21 of the print head 20 discharges one dot per the transportation distance d of the printing medium to the printing medium as the second flushing. However, the transportation speed of the printing medium by the transportation mechanism 16 is a/2 [m/s]. That is, the print control unit 12*b* makes the number of discharges of ink to the transported printing medium by the second flushing per fixed transportation distance to be constant regardless of the transportation speed of the printing medium. This is to avoid degradation of an image quality by increasing the number of ink discharges by the second flushing.

However, the example of FIG. 4B, compared to an example of FIG. 4A, requires twice the time for transportation of the transportation distance d, so that the rate of increase in viscosity of the ink with respect to the transportation distance d is greatly increased. Therefore, even if the ink discharge by the second flushing is performed at a rate of once per the transportation distance d, a sufficient effect to offset an increase of the viscosity of the ink caused by the elapse of time after a last ink discharge does not occur. Accordingly, when performing only the second flushing as the flushing in the example of FIG. 4B, the viscosity of the ink eventually reaches a predetermined threshold value TH of viscosity at a timing. Therefore, when the viscosity in the nozzle 21 reaches the threshold value TH while performing the second flushing similar to the example of FIG. 4A even in the example of FIG. 4B, the print control unit 12*b* performs the first flushing (refer to description of "the first FL" in FIG. 4B). Accordingly, the viscosity of the ink in the nozzle 21 is lowered to the substantially fixed level at once. After performing the first flushing, the second flushing (ink discharge to the printing medium at a rate of once per the transportation distance d of the printing medium) is performed again.

In the embodiment, viscosity which is lower than the viscosity of the ink to cause clogging in the nozzle 21 is assumed as the threshold value TH. In addition, the print control unit 12*b* detects the viscosity of the ink in the nozzle 21 in step S160. In this case, the print control unit 12*b* may directly detect the viscosity of the ink through a sensor and the like provided in the vicinity of the opening of the nozzle 21, and may indirectly detect the viscosity of the ink by counting predetermined information. In either case, the print control unit 12*b* functions as a viscosity detection unit. When directly detecting the viscosity of the ink in the vicinity of the opening of the nozzle 21, the print control unit 12*b* compares the detected viscosity of the ink with the threshold value TH, and when the detected viscosity of the ink is equal to or more than the threshold value TH, the print control unit 12*b* performs the first flushing. Alternately, the print control unit 12*b* determines whether the viscosity of the ink in the nozzle 21 is regarded to reach the threshold value TH or not. For example, when ink discharge by the second flushing is repeated at a rate of once per the transportation distance d in an environment where the transportation speed of the printing medium is the second speed, the number of the ink discharges, performed until when the viscosity of the ink in the nozzle 21 reaches the threshold value TH from the substantially fixed level, is defined in advance. Then, the print control unit 12*b* counts the number of ink discharges by the second flushing in step S160 (indirectly detects the viscosity of the ink in the nozzle 21), and when the counted number is the defined number, the print control unit 12*b* determines whether the viscosity of the ink in the nozzle 21 reaches the threshold value TH to perform the first flushing.

The print control unit 12*b* does not perform the first flushing right after a timing of determining that the viscosity of the ink in the nozzle 21 reaches the threshold value TH. For example, the first flushing is performed at a timing between pages after the viscosity of the ink in the nozzle 21 is determined to reach the threshold value TH, and the first flushing is performed at a timing when printing to one sheet of printing medium is finished. Assuming that the second printing setting where the transportation speed of the printing medium is slow is selected, when comparing step S160 with step S130, the former realizes a ratio of a certain degree of flushing required to prevent clogging of the nozzle using the second flushing, so that the former has the number of the first flushing less than the latter. Accordingly, time required to completely print an image to be printed in step S160 (even though the time is longer than in step S150) is basically shorter than in step S130.

According to the embodiment, the printer 10, when the image quality priority mode is selected by a user at the time when printing the image to be printed, performs flushing (the first flushing) to a place other than the printing medium, and when the speed priority mode is selected, the printer 10 performs flushing (the second flushing) to the printing medium. Therefore, by performing optimal flushing according to a demand of each user on the image quality and the speed of printing, it is possible to obtain a printing result with a high satisfaction of the user. In particular, in the printer 10 equipped with the print head 20 which is a line head, compared to a model in which the print head 20 can move in a main scanning direction, more time is required when performing the first flushing. Therefore, a configuration of the embodiment in which the second flushing is performed when the speed priority mode is selected greatly contributes to fast speed of printing in the printer 10 equipped with the line head.

In addition, the printer 10, even when the speed priority mode is selected and when a specific condition is satisfied to increase the viscosity of the ink in the nozzle 21 compared to a predetermined condition (a selection of the second printing setting is made), performs both the first flushing and the second flushing. At this time, the printer 10 makes the number of discharges of ink to the transported printing medium by the second flushing per a fixed transportation distance to be constant regardless of the transportation speed of the printing medium, and when the viscosity of the ink in the nozzle 21 reaches the threshold value TH, the printer 10 performs the first flushing. That is, even in a situation where the viscosity of the ink in the nozzle 21 is higher than usual (a situation where more flushing is required), it is possible to prevent degradation of the image quality and to inhibit deterioration in the printing speed as much as possible.

The printer 10 can discharge a plurality of types of dots whose ink amount per dot is different, from the nozzle 21. In this case, the printer 10 discharges a dot with a relatively small ink amount (a dot referred to as a small dot or the like) among the plurality of types of dots to avoid inconvenience such as an increase in visibility of a flushing dot on the printing medium (degradation of the image quality) in the second flushing. On the other hand, in the first flushing, since there is no need to consider the inconvenience, the printer can discharge a dot with a relatively large ink amount (a dot referred to as a large dot) among the plurality of types of dots. Therefore, the first flushing has a higher prevention effect of the clogging of the nozzle 21 by discharging the flushing dot once, than the second flushing. Accordingly, as in the embodiment, by using both the second flushing and the first flushing, it is possible to inhibit degradation of the image quality and the printing speed, and to realize a necessary and sufficient amount of flushing.

3. Modification Example

The present invention is not limited to the embodiments described above, and can be implemented in various embodiments without departing from the scope and the spirit of the invention, for example, in the following modification examples. Content with a combination of some or all of the embodiments described above and each modification example is also disclosed in the scope of the invention.

Modification Example 1

The temperature/humidity sensor 17 corresponds to a temperature/humidity detection unit in an aspect of the invention, and detects a temperature and/or a humidity of the environment in the vicinity of the print head 20. Higher temperature of the environment in the vicinity of the print head 20 than a predetermined threshold value of the temperature and lower humidity of the environment than a predetermined threshold value of the humidity mean that the thickening of the ink in the nozzle 21 is easily caused more than a predetermined condition which is a reference (temperature lower than the threshold value of the temperature, and/or, humidity higher than the threshold value of the humidity). Here, the print control unit 12*b* obtains a detection result by the temperature/humidity sensor 17. Then, for example, when the detected temperature is equal to or higher than the threshold value of the temperature, or when the detected humidity is equal to or lower than the threshold value of the humidity, whether the "specific condition is satisfied (Yes)" is determined in the step S140, and the process may proceed to the step S160. Alternately, when the detected temperature is equal to or higher than the threshold value of the temperature, and when the detected humidity is equal to or lower than the threshold value of the humidity, whether the "specific condition is satisfied (Yes)" is determined in step S140 and the process may proceed to the step S160.

In the step S160, the print control unit 12*b*, when performing both the first flushing and the second flushing on the print head 20, makes the number of discharges of ink onto the transported printing medium per a fixed transportation distance by the second flushing to be constant regardless of a detection result by the temperature/humidity sensor 17, and when the viscosity of the ink in the nozzle 21 reaches the threshold value TH, the print control unit 12*b* performs the first flushing. As described above, the print control unit 12*b* may determine whether the viscosity of the ink in the nozzle 21 is regarded to reach the threshold value TH or not. For example, when repeatedly performing ink discharge by the second flushing at a rate of once per the transportation distance d in an environment having temperature equal to or higher than the threshold value of the temperature and/or humidity equal to or lower than the threshold value of the humidity, the number of the ink discharges performed until the viscosity of the ink in the nozzle 21 reaches from the substantially fixed level to the threshold value TH is defined in advance. Then the print control unit 12*b* counts the number of ink discharges by the second flushing in the step S160 (indirectly detects the viscosity of the ink in the nozzle 21), and when the counted number is the defined number, the print control unit 12*b* determines that the viscosity of the ink in the nozzle 21 reaches the threshold value TH to perform the first flushing.

According to the modification example 1, the printer 10 can maintain an image quality in a situation where the viscosity of the ink in the nozzle 21 is higher than usual (a situation where more flushing is required. step S160) similar to that in a situation where the viscosity is not higher than usual (step S150) since the environment in the vicinity of the nozzle 21 has a relatively high temperature or a relatively low temperature, and may inhibit deterioration in the printing speed as much as possible.

Modification Example 2

In step S140, as an example of the "specific condition", it may be adapted that a humidification function of the humidified air supply unit 18*b* is degraded more than a predetermined reference. The humidification maintenance section 18 includes the humidification liquid tank 18*a* which stores a humidification liquid having a non-volatile component and the humidified air supply unit 18*b* which supplies air humidified by the humidification liquid stored in the humidification liquid tank 18*a* to a sealed space opposite to the opening of the nozzle 21 (refer to FIG. 1), and inhibits an increase in the viscosity of the ink in the nozzle 21. The detailed configuration of the humidification maintenance section 18 appropriately refers to a humidifying mechanism described in JP-A-2012-158070. When a remaining amount of the humidification liquid (water) stored in the humidification liquid tank 18*a* is in shortage, water is supplied to the humidification liquid tank 18*a*. Preservative for preventing spoilage of water is added to the supplied water. The preservative includes a non-volatile component, so that a density of the non-volatile component in the humidification liquid tank 18*a* is high by repeated evaporation and supply of water. When the density of the non-volatile component is high, a steam generation function in the humidification liquid tank 18*a* is degraded, and as a result, a humidification function of the humidified air supply unit 18*b* is degraded (a function of inhibiting an increase in the viscosity of the ink in the nozzle 21 is degraded).

Therefore, the print control unit 12*b* determines whether or not an amount of the non-volatile component in the water stored in the humidification liquid tank 18*a* is equal to or more than a regulated amount set in advance. Then, when the amount of the non-volatile component is equal to or more than the regulated amount, the humidification function of the humidified air supply unit 18*b* is regarded to be degraded more than the reference, the step S140 is determined as "Yes", and the process proceeds to the step S160. A method of determining whether or not the amount of non-volatile component in water is equal to or more than the regulated amount appropriately refers to the description in JP-A-2012-158070.

In the step S160, the print control unit 12*b* performs both the first flushing and the second flushing on the print head 20, thereby making the number of ink discharges onto the transported printing medium by the second flushing per the fixed transportation distance to be constant regardless of the level of the humidification function of the humidified air supply unit 18*b*, and when the viscosity of the ink in the nozzle 21 reaches the threshold value TH, the print control unit 12*b* performs the first flushing. As described above, the print control unit 12*b* may determine whether or not the viscosity of the ink in the nozzle 21 is regarded to reach the threshold value TH. For example, when repeating ink discharge by the second flushing at a rate of once per the transportation distance d in an environment where the amount of non-volatile component in the water in the humidification liquid tank 18*a* is equal to or more than the regulated amount, the number of the ink discharges performed until the viscosity of the ink in the nozzle 21 reaches the threshold value TH from the substantially fixed level is defined in advance. Then, the print control unit 12*b* counts the number of ink discharges by the second flushing in the step S160 (indirectly detects the viscosity of the ink in the nozzle 21), and when the counted number is the defined number, the viscosity of the ink in the nozzle 21 is determined to reach the threshold value TH to perform the first flushing.

According to the modification example 2, the printer 10 can maintain an image quality in a situation where the viscosity of the ink in the nozzle 21 is higher than usual (a situation where more flushing is required. Step S160) similar to that in a situation where the viscosity is not higher than usual (step S150), and inhibit deterioration in the printing speed as much as possible since a humidification function is lowered more than a reference by the humidified air supply unit 18*b*.

Modification Example 3

A case where the printer 10 performs processing in FIG. 3 described above is described as an example. However, the processing may be performed at the PC 40 side. That is, the printer driver 41 may perform a determination of steps S100 and S110 or steps S120 and S140 according to a program, and order the performance of processing of any of steps S130, S150, and S160 according to a result of the determination to the printer 10.

In addition, the liquid in this specification corresponds to everything, in addition to ink, which is liquid or fluid obtained when the viscosity thereof is changed by moisture or evaporation of a solvent.

The entire disclosure of Japanese Patent Application No. 2012-254178, filed Nov. 20, 2012 is expressly incorporated by reference herein.

What is claimed is:

1. A printing apparatus which can form an image formation dot for printing an image defined as an object to be printed on a printing medium, the printing apparatus comprising:

a line head which includes a nozzle array arraying a plurality of nozzles, by moving at least one of a printing medium and the head, in a direction intersecting a direction relatively changing a position of the printing medium and the head; and a control unit which performs a specific operation forming a flushing dot besides the image formation dot by discharging a liquid on the line head, wherein, when a specific condition increasing viscosity of the liquid is satisfied, the control unit performs the specific operation of discharging the liquid to the printing medium and also performs the specific operation of discharging the liquid to a place other than the printing medium, and wherein, when the specific condition is not satisfied, the control unit performs the specific operation of discharging the liquid to the printing medium and does not perform the specific operation of discharging the liquid to a place other than the printing medium.

2. The printing apparatus according to claim 1, wherein, when a printing setting related to the speed of the movement is the slowest speed in a range of the printing setting, the specific condition is satisfied.

3. The printing apparatus according to claim 2, wherein the printing setting of the slowest speed is a setting in which printing is performed using the highest printing resolution in a range of the printing setting.

4. The printing apparatus according to claim 1, further comprising a viscosity detection unit which detects viscosity of the liquid in the nozzle, wherein, when the viscosity detected by the viscosity detection unit reaches a predetermined threshold value of the viscosity, the specific condition is satisfied.

5. The printing apparatus according to claim 1, wherein, when receiving a setting in which printing is performed on both sides of the printing medium, the specific condition is satisfied.

6. The printing apparatus according to claim 1, further comprising a temperature/humidity detection unit which detects a temperature and/or a humidity of an environment, wherein, when the temperature/humidity detection unit detects the temperature equal to or more than a predetermined threshold value of the temperature, and/or the humidity equal to or less than a predetermined threshold value of the humidity, the specific condition is satisfied.

7. The printing apparatus according to claim 6, further comprising a viscosity detection unit which detects viscosity of the liquid in the nozzle, wherein, when the temperature/humidity detection unit detects the temperature equal to or more than a predetermined threshold value of the temperature, and/or the humidity equal to or less than a predetermined threshold value of the humidity, and the viscosity detected by the viscosity detection unit reaches a predetermined threshold value of the viscosity, the specific condition is satisfied.

8. The printing apparatus according to claim 1, further comprising:

a humidification liquid tank which stores a humidification liquid having a non-volatile component; and a humidified air supply unit which supplies air humidified by the humidification liquid stored in the humidification liquid tank to a sealed space facing an opening of the nozzle, wherein, when a humidification function by the humidified air supply unit is degraded more than a predetermined reference, the specific condition is satisfied.

9. The printing apparatus according to claim 8, wherein the control unit determines whether an amount of the non-volatile component in the humidification liquid stored in the humidification liquid tank is equal to or more than a regulated amount, and when the amount of the non-volatile component is equal to or more than the regulated amount, determines that the humidification function by the humidified air supply unit is degraded more than the predetermined reference.

10. The printing apparatus according to claim 1, further comprising:

a selection receiving unit that receives a selection of one of a first printing mode and a second printing mode, the first printing mode giving priority to printing quality and the second printing mode giving priority to printing speed, wherein, when the first printing mode is selected, the control unit performs the specific operation of discharging the liquid to a place other than the printing medium and does not perform the specific operation of discharging the liquid to the printing medium.

11. A printing method performed by a printing apparatus which can form an image formation dot for printing an image defined as an object to be printed on a printing medium by moving at least one of a printing medium and the line head, the printing apparatus including a line head which has a nozzle array arraying a plurality of nozzles, the printing method comprising:

performing a specific operation of forming a flushing dot besides the image formation dot by discharging a liquid on the line head, including discharging the liquid to a printing medium and discharging the liquid to a place other than the printing medium, when the specific condition is satisfied, and discharging the liquid to the printing medium and not discharging the liquid to a place other than the printing medium, when the specific condition is not satisfied.

* * * * *